US011158438B2

(12) United States Patent
Kukowski et al.

(10) Patent No.: US 11,158,438 B2
(45) Date of Patent: Oct. 26, 2021

(54) CARBON NANOTUBE BASED CABLING

(71) Applicant: Minnesota Wire, Inc., St. Paul, MN (US)

(72) Inventors: Thomas Kukowski, Apple Valley, MN (US); Mike Matuszewski, St. Paul, MN (US)

(73) Assignee: Minnesota Wire, St Paul (MN)

( * ) Notice: Subject to any disclaimer, the term of this patent is extended or adjusted under 35 U.S.C. 154(b) by 0 days.

(21) Appl. No.: 16/793,102

(22) Filed: Feb. 18, 2020

(65) Prior Publication Data

US 2020/0388415 A1 Dec. 10, 2020

Related U.S. Application Data

(63) Continuation of application No. 15/968,375, filed on May 1, 2018, now abandoned.

(51) Int. Cl.

| | |
|---|---|
| ***H01B 1/02*** | (2006.01) |
| ***H01B 7/00*** | (2006.01) |
| ***H01B 1/04*** | (2006.01) |
| ***H01B 13/016*** | (2006.01) |
| ***H01B 13/00*** | (2006.01) |
| ***H01B 11/18*** | (2006.01) |
| *H01B 11/10* | (2006.01) |

(52) U.S. Cl.

CPC ..... *H01B 7/0009* (2013.01); *H01B 1/02* (2013.01); *H01B 1/04* (2013.01); *H01B 11/1808* (2013.01); *H01B 13/0036* (2013.01); *H01B 13/0162* (2013.01); *H01B 11/1033* (2013.01); *H01B 11/1813* (2013.01); *H01B 11/1834* (2013.01)

(58) Field of Classification Search

CPC ... H01B 1/02; H01B 1/04; H01B 7/02; H01B 7/04; H01B 7/009; H01B 11/1033; H01B 11/1813; H01B 11/1834; H01B 13/0162

USPC ..... 174/102 R, 103, 106 R, 108, 109

See application file for complete search history.

(56) References Cited

U.S. PATENT DOCUMENTS

| | | | | |
|---|---|---|---|---|
| 9,111,658 | B2 * | 8/2015 | Shah | H05K 9/009 |
| 9,193,586 | B2 * | 11/2015 | Wei | H01B 7/30 |
| 2007/0151744 | A1 * | 7/2007 | Chen | H01B 1/026 174/110 R |
| 2007/0293086 | A1 * | 12/2007 | Liu | H01B 11/1808 439/578 |
| 2008/0170982 | A1 * | 7/2008 | Zhang | B29C 48/0019 423/447.3 |
| 2009/0255706 | A1 * | 10/2009 | Jiang | H01B 1/24 174/102 R |
| 2011/0005808 | A1 * | 1/2011 | White | H02K 3/02 174/126.2 |
| 2012/0125656 | A1 * | 5/2012 | Wei | B82Y 30/00 174/103 |

(Continued)

*Primary Examiner* — William H. Mayo, III

(74) *Attorney, Agent, or Firm* — FisherBroyles LLP; Gregory T. Fettig

(57) ABSTRACT

A cable has a first conductive core configured from a first strand of carbon nanotubes (CNTs), a first copper coating surrounding the strand of CNTs along a length of the cable. The cable also has a first shielding configured from CNTs and copper and surrounding the first core along the length of the cable. The cable also has a second shielding configured from CNTs and copper and surrounding the first shielding along the length of the cable. The cable also has a jacket surrounding the second shielding along the length of the cable.

10 Claims, 5 Drawing Sheets

(56) References Cited

U.S. PATENT DOCUMENTS

| | | | | |
|---|---|---|---|---|
| 2012/0277800 | A1* | 11/2012 | Jackson | A61B 17/7037<br>606/265 |
| 2014/0102755 | A1* | 4/2014 | Adriaenssens | H01B 1/04<br>174/113 R |
| 2017/0236621 | A1 | 8/2017 | Silverman et al. | |

* cited by examiner

CARBON NANOTUBE BASED CABLING

CROSS REFERENCE TO RELATED APPLICATIONS

This patent application claims priority to, and thus the benefit of an earlier filing date from, U.S. patent application Ser. No. 15/968,375 (filed May 1, 2018), which claims priority to U.S. Provisional Patent Application No. 62/492,878 (filed May 1, 2017), the contents of each of which are hereby incorporated by reference.

BACKGROUND

Cabling is ubiquitous. For example, power cables, coaxial cables, and electrical cables, and the like can be found in a variety of industries, such as the building industry, the aerospace industry, the telecommunications industry, and the automotive industry. These cables are configured with some form of metal, such as copper, in an application dependent configuration. For example, a coaxial cable may have a copper core surrounded by a dielectric, which is then shielded typically with a braided metal or foil. Twisted pair conductors have solid metal cores (e.g., copper) surrounded by insulators.

These metal cores, while necessary for their respective applications, add significantly to the weight of the cable. And, weight savings is an important issue in many industries. For example, aircraft contain many wires and cables that significantly increase the overall weight of the aircraft. This weight increase requires the aircraft to use more fuel. But, the cables are necessary as they serve a variety of purposes, including the support of communication and navigation electronics. Reducing the weight of the wire and cabling of the aircraft can reduce the amount fuel necessary to fly the aircraft, thereby reducing costs. However, cable reliability is still critical in aircraft as cable failure can be catastrophic.

SUMMARY

In one embodiment, a cable comprises a conductive core comprising a strand of carbon nanotubes electroplated (e.g., with silver and/or copper), a shielding surrounding the core along the length of the cable, and a jacket surrounding the shielding along the length of the cable. In another embodiment, a cable production method comprises configuring a plurality of carbon nanotubes into a strand, and electroplating the strand of carbon nanotubes (e.g., with silver and/or copper) to form a conductive core. The method also comprises braiding a shielding around the strand of electroplated carbon nanotubes along the length of the cable, surrounding the shielding with a jacket along the length of the cable. In yet another embodiment, a cable comprises a first conductive core comprising a strand of carbon nanotubes electroplated (e.g., with silver and/or copper), a first insulator surrounding the first core along a length of the cable. The cable also comprises a second conductive core comprising another strand of carbon nanotubes electroplated (e.g., with silver and/or copper), and a second insulator surrounding the second core along the length of the cable. The cable also comprises a shielding surrounding the two insulators along the length of the cable, and an outer jacket configured along the length of the cable. The shielding is configured from electroplated carbon nanotubes that have been braided, electroplated carbon nanotube paper, or a combination thereof.

DETAILED DESCFRIPTION OF THE DRAWINGS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention and are to be construed as being without limitation to such specifically recited examples and conditions. As a result, the invention is not limited to the specific embodiments or examples described below.

Figure 1:
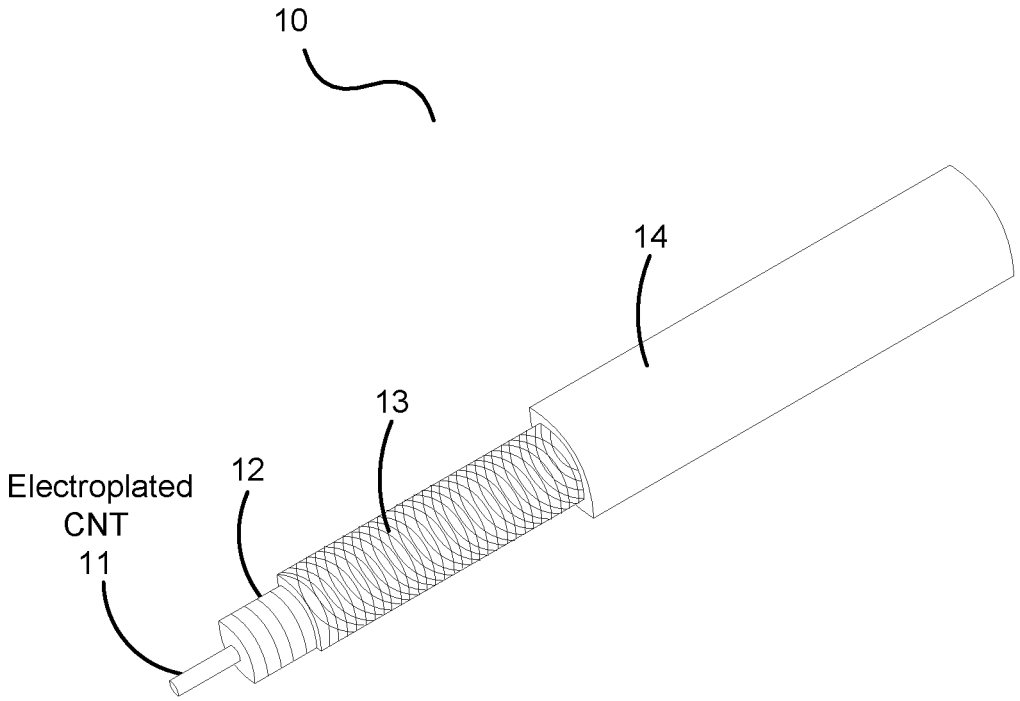
FIG. 1 is a perspective view of one exemplary cable.

FIG. 1 is a perspective view of one exemplary cable 10. In this embodiment, the cable is configured with a conductive core 11. The conductive core 11 comprises a strand of carbon nanotubes that has been electroplated (e.g., with silver (Ag) and/or copper (Cu)). The carbon nanotubes are generally grown in a chamber to produce a "yarn". For example, tungsten foil may be sputtered with iron as part of a "seeding" process to produce the carbon nanotubes. Then, the sputtered tungsten foil may be placed in a chamber through which acetylene gas passes. As the sputtered tungsten foil is heated, carbon nanotubes tend to "grow" on the surface of the foil. Once collected, the carbon nanotubes have the material appearance of wool.

The carbon nanotube "wool" is spun into a yarn/strand to form the core of the conductor. While the strand of carbon nanotubes is generally conductive, it still may not produce the results required in certain industries, such as the aerospace and satellite industries. For example, aircraft and satellites have incredibly stringent requirements in terms of signaling and conduction to prevent catastrophic failure. So, to improve the conductivity of the carbon nanotube strand, the carbon nanotube strand is electroplated with a metal, such as silver and/or copper.

In traditional cabling, copper is used due to its high conductivity and plentiful nature. For example, silver is the most conductive metal on earth. However, silver is expensive due to its rarity. Copper has the second highest conductivity of metals on earth and is much more abundant than silver. So, copper is typically used in cabling where conductivity is necessary (e.g., signaling, power, etc.).

Of course, the objectives of the present embodiments are to reduce the weight associated with metals in cabling. To accomplish such, the embodiments herein present a carbon nanotube strand which is electroplated to enhance the conductivity of the conductive core 11. This also provides the carbon nanotube strand with a desired level of rigidity. In some embodiments, the process involves placing the strand of carbon nanotubes in a bath of copper solution (e.g., copper sulfate). The strand is connected to a voltage source and acts as the cathode. A copper anode in the bath transfers copper to the strand when a voltage is applied. Silver can further enhance the conductivity through electroplating in a similar fashion albeit with a different electrolyte (e.g., AgNO3).

Once the conductive core 11 is configured, the conductive core may be configured with a dielectric material 12. The dielectric material 12 may be configured about the conductive core along a length of the cable 10 in a variety of ways as a matter of design choice and/or application. For example, when configuring the cable 10 as a conductor (e.g., as in a twisted pair configuration), the dielectric 12 may be used as an insulator. When configuring the cable 10 as a coaxial cable, the dielectric 12 may indeed operate as a dielectric material with a certain level impedance.

The impedance of the dielectric 12 may be configured to be adjustable. For example, the dielectric 12 may be an expanded Polytetrafluoroethylene (ePTFE) tape that is wrapped about the conductive core 11. The number of layers/wrappings of the tape about the conductive core 11 may determine the thickness of the dielectric 12. Thus, by changing the thickness of the dielectric 12 based on the number of layers/wrappings of the tape about the conductive core 11, the impedance of the dielectric 12 can be adjusted as a matter of design choice.

Alternatively or additionally, the conductive core 11 may be embedded in a dielectric material. For example, the conductive core 11 may be embedded in plastic which is subsequently hardened. Then, the conductive core 11 and the dielectric material 12 can be extruded to form a sturdier cable.

In whatever case, once the dielectric 12 is configured with the conductive core 11, the cable 10 is shielded with a suitable shielding material 13. For example, the dielectric 12 may be surrounded with a metallic braiding (e.g., copper, aluminum, silver etc.). Alternatively or additionally, the dielectric 12 may be surrounded with a metallic foil. In one embodiment, the shielding 13 may be configured in a manner such as the conductive core 11 itself. For example, the shielding may be configured from strands of carbon nanotubes that are electroplated with copper and/or silver which can then be braided about the dielectric 12 along the length of the cable 10.

Once the shielding is installed, the cable 10 may be protected within outer protective jacket 14. Any of several materials may be used to provide the protective jacket 14, such as shrink-wrap plastics and tapes, rubber, etc. The cable 10 may then be used in any variety of cabling including a coaxial cable configuration, a twisted pair configuration, an ethernet configuration, a category 5 cable configuration, and/or a category 6 cable configuration.

In one embodiment, the strand of carbon nanotubes is electroplated with copper first and then silver. But, the embodiments herein are not intended to be limited to any order of electroplating or type of metal used in said electroplating, such as gold and tin. Some embodiments herein use copper and silver due to its conductivity performance.

It should be noted that the embodiments herein are only intended to provide the reader with an exemplary embodiment so as to assist the reader in understanding the inventive concepts herein. Additionally, it should be noted that the cable 10 is not intended to be limited to any particular length and/or cross-sectional size/shape as such features are matter of design choice.

Figure 2:
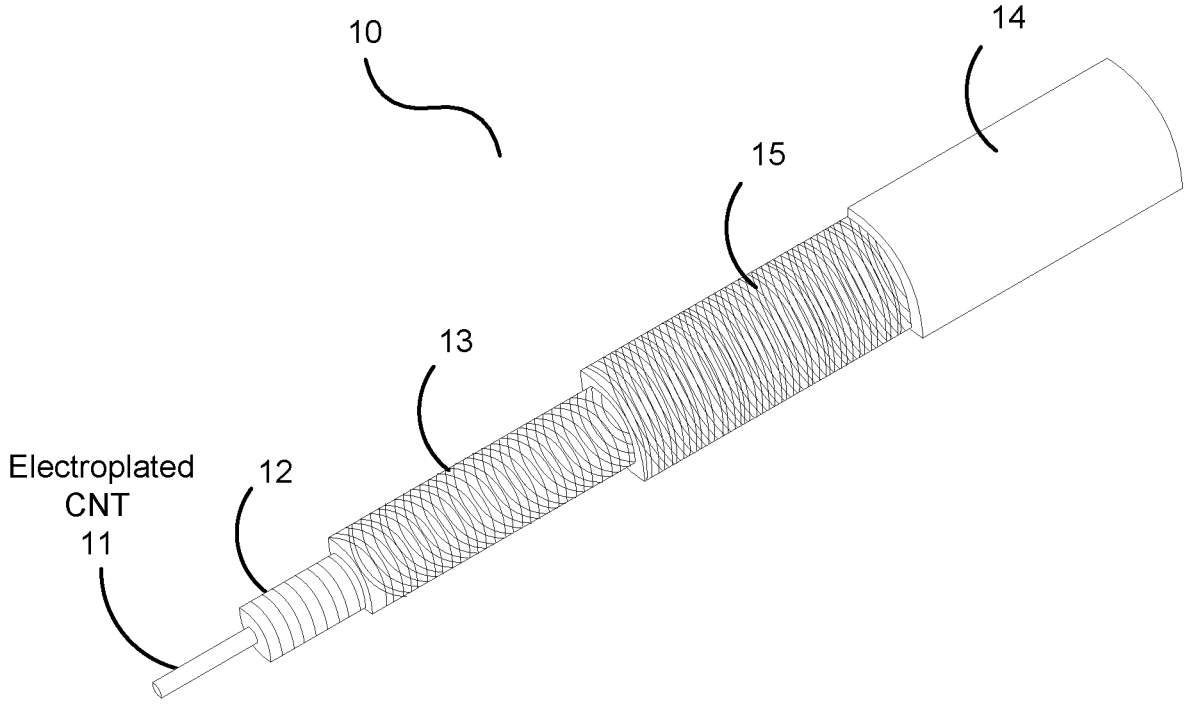
FIG. 2 is a perspective view of another exemplary cable.

FIG. 2 is a perspective view of another exemplary cable 10. In this embodiment, the cable 10 is similarly configured to the cable 10 in FIG. 1. In this embodiment, however, the cable 10 is also configured with another shielding 15 between the protective jacket 14 and the shielding 13. Like the shielding 13, the shielding 15 may be configured in a variety of ways as a matter of design choice, including electroplated carbon nanotube strands, braided metal, foil, or the like. In this embodiment, the cable 10 is operable as a coaxial cable (e.g., once it is configured with a coaxial cable termination). And, as a coaxial cable, the cable 10 is operable to pass frequencies from about 100 MHz to beyond 16 GHz, depending on the configuration.

Figure 3:
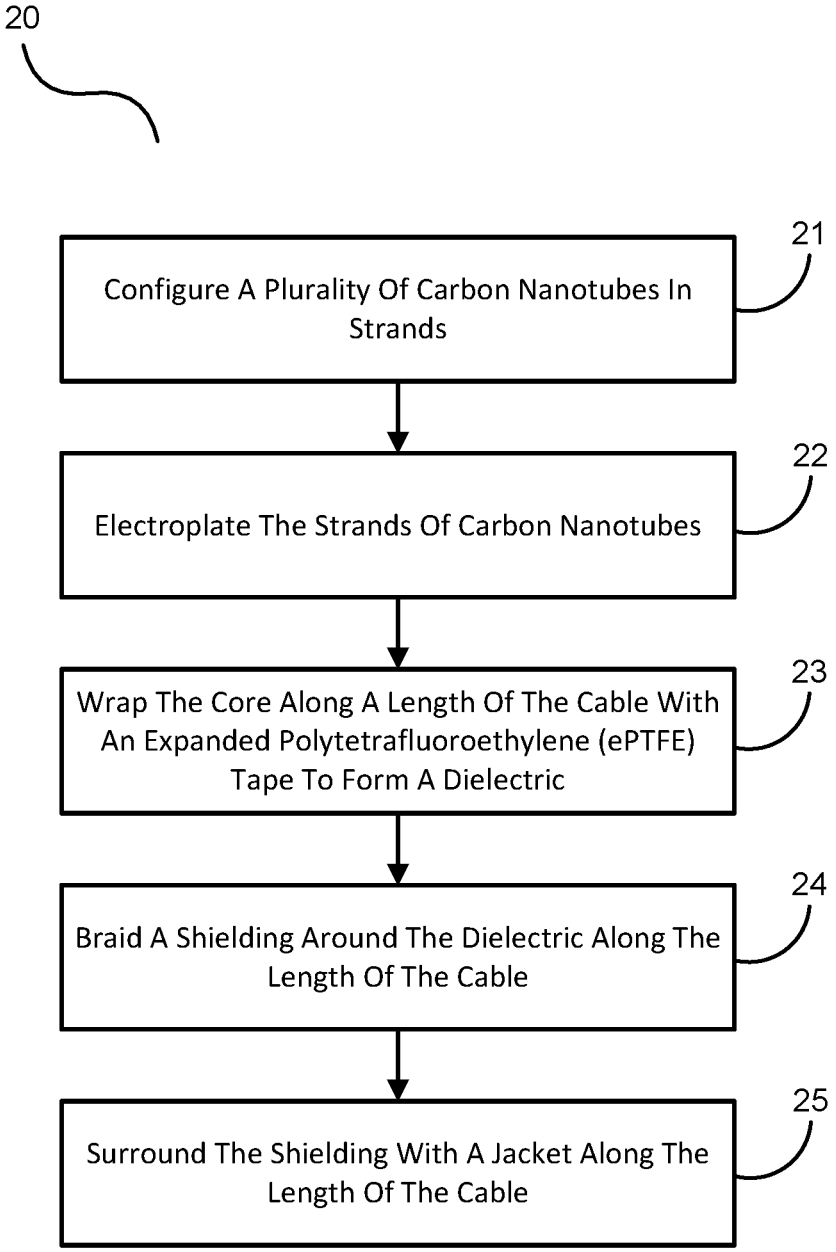
FIG. 3 is a flowchart of an exemplary process for making a cable.

FIG. 3 is a flowchart of an exemplary process 20 for making the cable 10. In this embodiment, the process 20 begins after a carbon nanotube wool has been grown and collected. Then, the carbon nanotube wool is spun into strands, in the process element 21. Thereafter, the strands of carbon nanotubes are electroplated (e.g., with silver and/or copper), in the process element 22. For example, a strand of carbon nanotubes may be configured as a cathode that is placed in a bath of a copper solution (e.g., with a copper anode) and then in a bath of a silver solution (e.g., with a silver anode). Then, when a voltage is applied, the corresponding metal electrolytes electroplate to the strand of carbon nanotubes. Once the electroplating is complete, the carbon nanotubes form the conductive core 11 of the cable 10.

With the conductive core 11 configured, it may then be wrapped along the length of the cable with an ePTFE tape to form a dielectric 12 about the conductive core, in the process element 23. Again, the impedance of the dielectric 12 may be determined by the number of times that the ePTFE tape is wrapped/layered about the conductive core 11. Once the dielectric 12 is configured with the conductive core 11, the cable 10 is braided with a shielding 13 around the dielectric 12 along the length of the cable 10, in the process element 24. Then the cable 10 is surrounded with a protective jacket outside of the shielding 13 along the length of the cable, in the process element 25.

Figure 4:
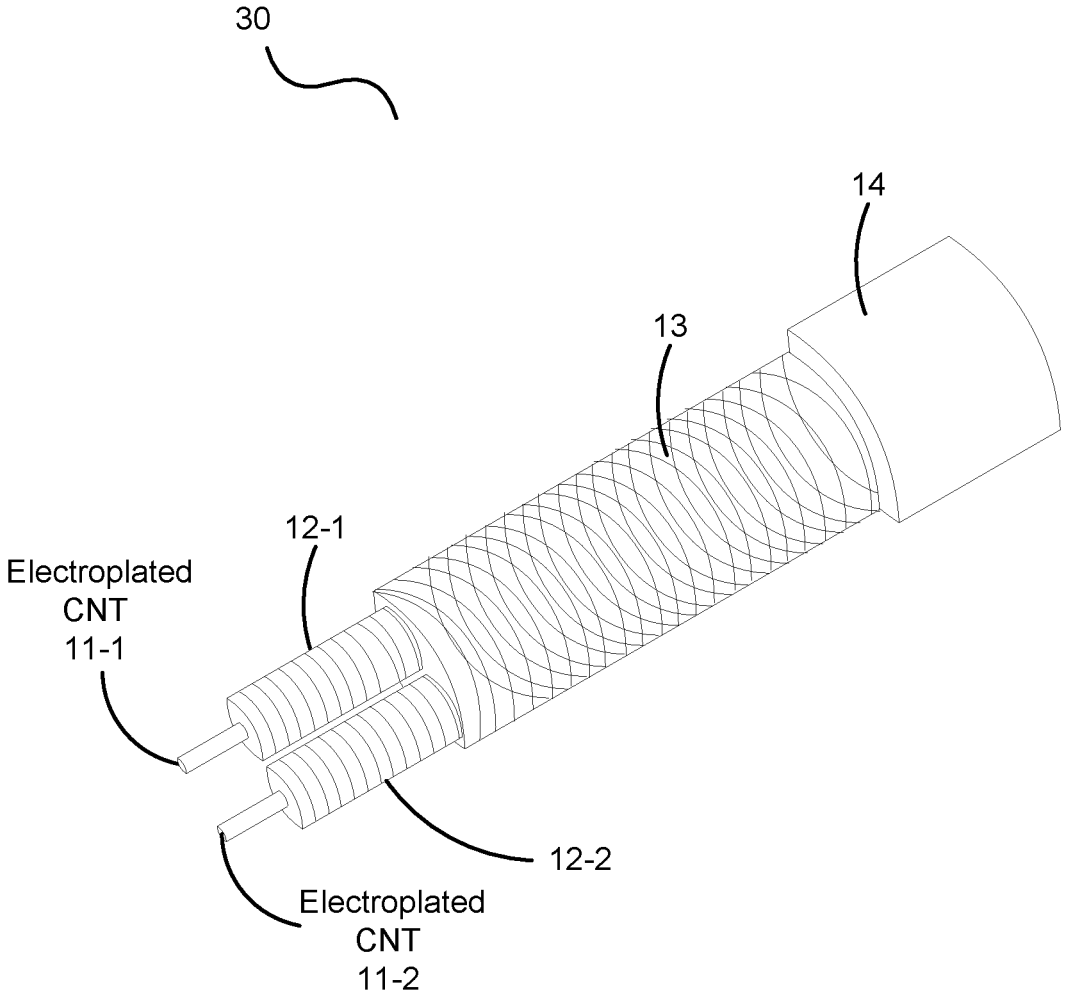
FIG. 4 is a perspective view of an exemplary twisted pair cable.

FIG. 4 is a perspective view of an exemplary twisted pair cable 30. In this embodiment, the twisted pair cable 30 comprises many of the components in the above embodiment, albeit configured differently. For example, the cable 30 comprises two carbon nanotube conductors 11-1 and 11-2 that have been electroplated (e.g., with silver and/or copper). The conductors 11-1 and 11-2 may then each be surrounded with an insulator 12. In this embodiment, the insulators 12-1 and 12-2 are surrounded with ePTFE tape (e.g., which can also function as a dielectric depending on the application) wrapped about each of the conductive cores 11-1 and 11-2. Of course, the conductive cores 11-1 and 11-2 may be surrounded with an insulator in other ways as a matter of design choice (e.g., embedded in rubber or plastic and extruded). The insulated conductive cores may then be shielded with a shielding material 13 (e.g., braided metal, braided electroplated carbon nanotubes conductors, foil, electroplated carbon nanotube "paper", etc.). Once shielded, the cable 30 is surrounded with an outer protective jacket 14 as described above.

Although shown and described as a single twisted pair cable configuration, those skilled in the art will readily recognize that the number of "twisted pairs" can be expanded. For example, in a category 5 cable configuration, the cable 30 may be configured with multiple twisted pairs. Thus, in a category 5 cable configuration with four twisted pairs, the cable 30 would have eight conductive cores 11 configured from electroplated carbon nanotube strands (e.g., using silver and/or copper). Each of those strands would be insulated and the entire cable 30 may then be surrounded with a shielding material, as described above. Accordingly, the embodiment is not intended to be limited to any number of twisted pairs.

Figure 5:
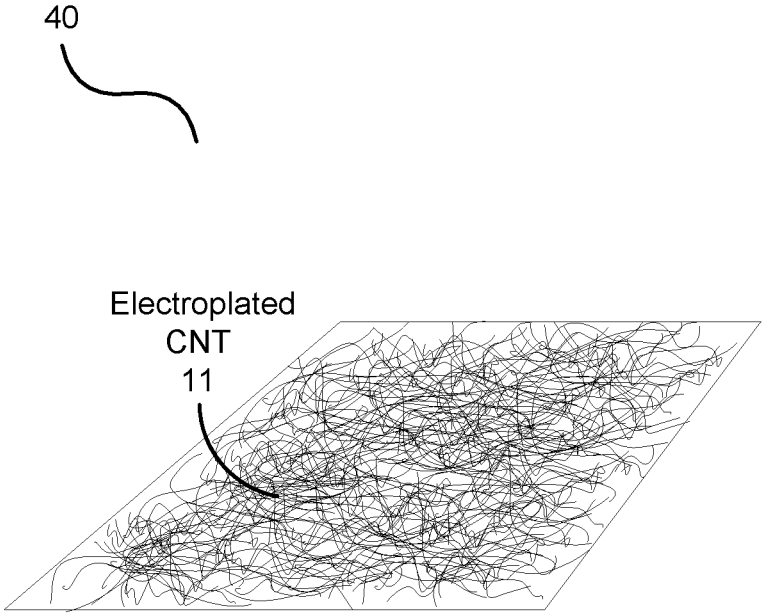
FIG. 5 is a perspective view of an exemplary electroplated carbon nanotube paper.

FIG. 5 is a perspective view of an exemplary electroplated carbon nanotube paper 40. For example, once the carbon nanotubes are grown and collected as a wool, the carbon nanotubes may be configured into strands that are then electroplated (e.g., using silver and/or copper) as described above. Then, the electroplated strands may be laid out in a sort of paper or even adhered to a tape that can be wrapped around an insulator to form a shielding. Alternatively, the electroplated strands may be braided to form a shielding.

Whatever the configuration, the electroplated carbon nanotubes advantageously provide a means for weight reduction in cabling. Again, traditional metal core cables at significant weight. The embodiments herein significantly reduce the cable weight, thereby reducing costs and certain industries, such as the aircraft industry. Other examples of industries that could benefit from reduced cabling weight include satellite production. For example, the cost of developing and producing satellites is linearly proportional to the satellite's weight. Large satellites, which weigh more than 1,000 Kilograms (kg), cost about $250 million or more. Micro-satellites, which weigh 10 and 100 kg, cost around $3 million. Mini-satellites, which weigh between 100 and 500 kg, as well as enhanced micro-satellites, cost around $14 million each. Satellites often cost more than $200,000 per kilogram, reaching $1 million per kilogram with delivery-to-space costs included. For example, transportation costs to geosynchronous orbits using a National Aeronautic Space Agency (NASA) reusable launch vehicle vary from $10,000 per pound of payload to greater than $160,000 per pound. And, the scarcity of annual launches forces organizations to make the most of each launch by maximizing the satellite capability/size/weight to the target class of launch vehicle.

In an effort to minimize launch costs, a smaller satellite paradigm (e.g., CubeSats) proposes to reduce size, weight, and power consumption of satellites while not reducing payload capabilities. Significant weight reductions can enable the use of small launch vehicles, which can be on the order of 50 percent less than a medium launch vehicle.

Furthermore, each kilogram saved in the satellite bus or instruments represents a potential 5 kg savings in launch, onboard propulsion, and altitude-control systems mass. This reduced mass also has the capability to produce indirect cost savings via shorter transit times, mission duration, and eliminating the need for large facilities and costly equipment, such as high bays, clean-room areas, test facilities and special handling equipment and containers.

It has been a challenge to find ways of effectively shielding sensitive electronic equipment from electromagnetic interference (EMI) without adding significantly to the weight of satellites. The more massive a satellite is, the more fuel it needs to achieve orbit. EMI shielding for wire and cables is an attractive opportunity for weight reduction. For example, copper wiring makes up as much as one-third of the weight of a 15-ton satellite. Half of this wire weight is typically in the EMI shielding. However, it is important that weight reductions do not come at the expense of EMI shielding effectiveness. Wiring and connectors are particularly vulnerable to electromagnetic interference. By substituting products that offer comparable shielding effectiveness, satellites can achieve dramatic weight-savings with minimal risk to the applications it serves.

Systems and methods presented herein provide for weight savings associated with cables. In some embodiments, more than 20 pounds per 1,000 linear feet in weight savings is possible by replacing the traditional copper components with the electroplated carbon nanotube components. For example, by incorporating the above embodiments in low voltage differential signaling (LVDS), the cabling has a signaling performance comparable to that of traditional Commercial Off-The-Shelf (COTS) LVDS cabling, but with a weight reduction of more than 40 percent. And, the cabling has a demonstrated signal integrity compliance between 1 and 3 Gbps for lengths of 3 to 30 feet.

In one embodiment, the strand of carbon nanotubes is electroplated first with copper so as to provide a base-layer under coat of the carbon nanotubes. This helps to eliminate course roughness and enable concentricity with the conductor cross-sectional circular symmetry. Then, conductivity is enhanced with a layer of silver which also maintains smoothness and concentric symmetry of the finished conductive core 11.

What is claimed is:

1. A cable, comprising:

a first conductive core comprising:

a first strand of carbon nanotubes (CNTs); and a first copper coating surrounding the strand of CNTs along a length of the cable;

an expanded Polytetrafluoroethylene (ePTFE) tape wrapped about the first conductive core to function as a dielectric that adjustably changes impedance based on a thickness of the tape;

a first shielding surrounding the ePTFE tape along the length of the cable, wherein the first shielding comprises CNTs and copper; and a second shielding surrounding the first shielding along the length of the cable, wherein the second shielding comprises CNTs and copper;

a jacket surrounding the second shielding along the length of the cable.

2. The cable of claim 1, further comprising:

an insulator configured between the first core and the first shielding and surrounding the first core along the length of the cable.

3. The cable of claim 1, further comprising:

a second conductive core comprising:

a second strand of CNTs; and a second copper coating surrounding the strand of CNTs along a length of the cable;

an expanded Polytetrafluoroethylene (ePTFE) tape wrapped about the first conductive core to function as a dielectric that adjustably changes impedance based on a thickness of the tape;

a third shielding surrounding the ePTFE tape along the length of the cable, wherein the third shielding comprises CNTs and copper; and a fourth shielding surrounding the third shielding along the length of the cable, wherein the fourth shielding comprises CNTs and copper;

a jacket surrounding the fourth shielding along the length of the cable.

4. The cable of claim 3, wherein:

the second conductive core further comprises a silver coating surrounding the second strand of CNTs along a length of the cable.

5. The cable of claim 3, wherein:

the first shielding further comprises silver.

6. The cable of claim 3, wherein:

the second shielding further comprises silver.

7. The cable of claim 3, further comprising:

an insulator configured between the second core and the third shielding and surrounding the second core along the length of the cable.

8. The cable of claim 1, wherein:

the first conductive core further comprises a silver coating surrounding the first strand of CNTs along a length of the cable.

9. The cable of claim 1, wherein:

the first shielding further comprises silver.

10. The cable of claim 1, wherein:

the second shielding further comprises silver.

* * * * *